United States Patent [19]

Ichiguchi

[11] Patent Number: 4,961,807

[45] Date of Patent: Oct. 9, 1990

[54] METHOD OF PRODUCING GRINDING TOOL AND APPARATUS FOR PRODUCING SAME

[76] Inventor: Hirokazu Ichiguchi, 3451-2, 2-chome, Gakuenmidorigaoka, Nara City, Nara Prefecture, Japan

[21] Appl. No.: 286,065

[22] Filed: Dec. 19, 1988

[30] Foreign Application Priority Data

May 14, 1988 [JP] Japan ..... 63-117922
Jun. 20, 1988 [JP] Japan ..... 63-152891

[51] Int. Cl.[5] ..... B20D 13/14

[52] U.S. Cl. ..... 156/261; 51/297; 51/334; 156/263; 156/518; 156/522

[58] Field of Search ..... 156/60, 556, 522, 552, 156/516, 518, 522, 261, 263, 265; 51/293, 297, 336, 334

[56] References Cited

U.S. PATENT DOCUMENTS 2,796,337 6/1957 Block ..... 51/293
3,241,267 3/1966 Block ..... 51/293 X
4,679,360 7/1987 Eisenblatter ..... 51/337

FOREIGN PATENT DOCUMENTS 228431 10/1959 Australia ..... 51/337

*Primary Examiner*—David Simmons

*Attorney, Agent, or Firm*—Spencer & Frank

[57] ABSTRACT

A method of and apparatus for producing a grinding tool which includes a several grinding sheets radially arranged on a disk. The disk, having a hole in its center and adhesive along a circumferential edge portion of its upper surface, is provided on a receiving seat. A plurality of grinding belts distributed about the periphery of the receiving seat are directed radially inward toward the center of the disk so as to cover the adhesive and such that adjacent side edges of forward ends of the belts overlap each other, each of the overlapping belt ends having a grinding particle surface on a same side thereof facing away from the adhesive. A pressing plate is directed downward against the respective belt ends on the adhesive layer to adhere the respective belt ends to the disk. A cutting tool having a circumferential cutting edge is provided below and somewhat radially outward of the circumferentially edge of the disk. When the pressing plate is lowered, the cutting edge cuts the belts along a circular line which is coaxial with the disk. The pressing plate is held against the belt ends while the adhesive solidifies. The pressing plate is then raised so that the completed grinding tool can be removed from the receiving seat. The adhesive may or may not be heat sensitive. If the adhesive is heat sensitive, heating elements are provided in the pressing member and the receiving seat to melt the adhesive.

7 Claims, 12 Drawing Sheets

METHOD OF PRODUCING GRINDING TOOL AND APPARATUS FOR PRODUCING SAME

BACKGROUND OF THE INVENTION

The present invention relates to a method of producing and an apparatus for producing a grinding tool comprising a large number of grinding sheets radially arranged and collected to be adhered to each other in a disk-like shape.

A grinding tool comprising a large number of rectangular grinding sheets radially arranged and collected to be adhered to each other in a circular shape has been frequently used in various kinds of grinding machine.

As to the general construction of a grinding tool, a large number of rectangular grinding sheets 51 are radially arranged and collected with overlapping side edges thereof to construct a ring grinding plate 52, as shown in FIG. 20.

A disk 53 provided with a hole for passing a driving shaft of the grinding machine therethrough at a center thereof is made of a fiber board or the like. The above-described grinding plate 52 is stuck to one side of the disk 53 with adhesives so as to be coaxial with the disk 53.

A method of producing the above-described grinding tool is described in detail below. The rectangular grinding sheets 51 are manually placed side-by-side respective radial grooves formed in an upper surface of a jig (not shown) one-by-one in good order, to form the ring grinding plate 52.

Next, the disk 53, to whose one surface the adhesives have been applied, is overlapped on said grinding plate 52, with a screw shaft standing at a center of the jig being passed through central holes of the above described grinding plate 52 and disk 53, and said grinding plate 52 and said disk 53 being screwed onto the jig by means of a nut screwed in from an upper end of this screw, shaft. Such an operation, requires substantial labor to perform, so that as a result, the grinding tool can not be produced on a large scale and the production cost is therefore quite high.

Thus, it is a first object of the present invention to provide a method of efficiently producing a grinding tool without any manual operation.

It is a second object of the present invention to provide an apparatus for efficiently producing a grinding tool from grinding sheets automatically supplied without any manual operation.

DESCRIPTION OF THE DRAWINGS

These and other objects and features of the present invention can be understood in detail from the following description with reference to the appended drawings showing one preferred embodiment of the present invention.

FIG. 7 is a longitudinally sectioned front view showing the condition where the cap plate is manually screwed on;

DESCRIPTION OF THE PREFERRED EMBODIMENTS

Figure 4:
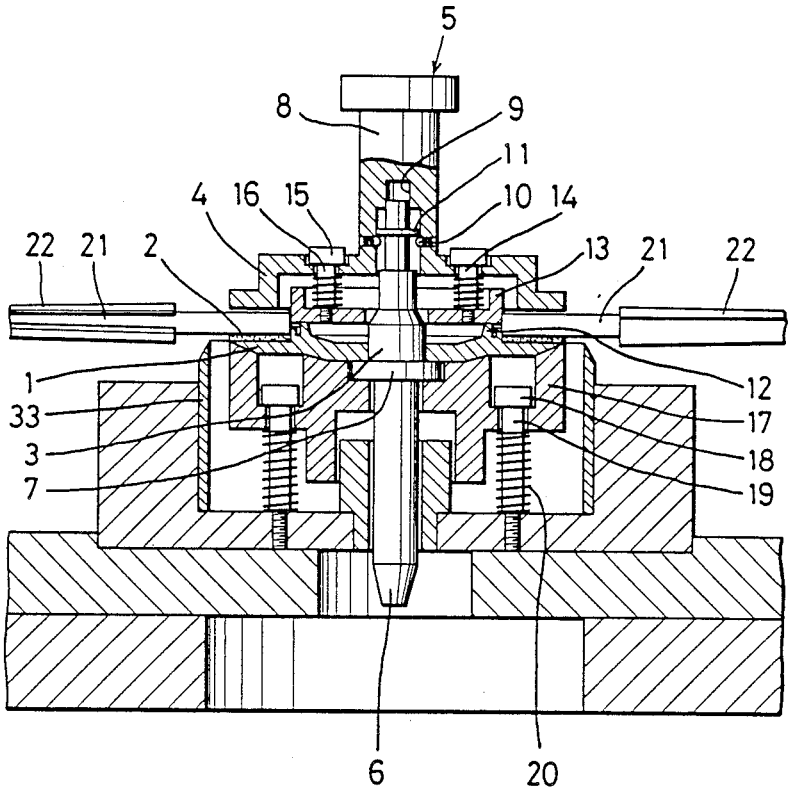
FIG. 4 is a longitudinally sectioned front view showing the feeding of grinding belts.
Figure 5:
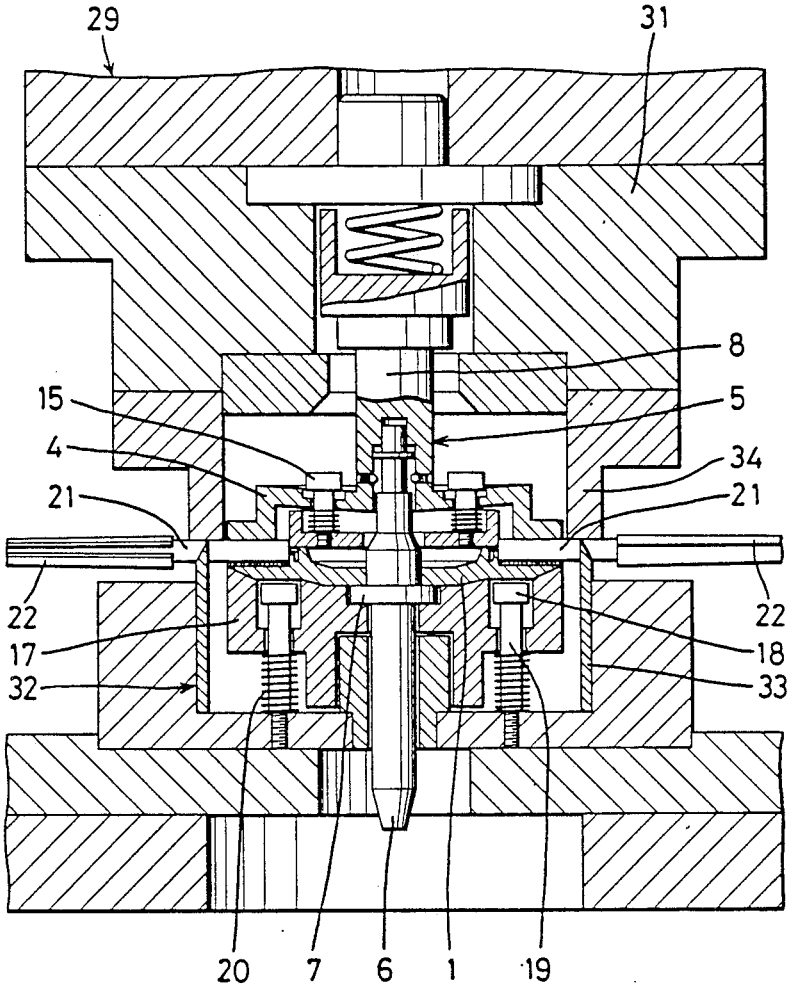
FIG. 5 is a longitudinally sectioned front view similar to FIG. 4, showing the condition when pressurized.

Referring to FIGS. 4, 5, reference numeral 1 designates a disk made of metal or fiber board provided with a hole 3 at the center thereof, adhesives 2 being applied to appointed places on a circumferential edge portion of an upper surface of said disk 1.

Reference numeral 4 designates a cap or pressing plate disposed on said disk 1 by means of binding means 5. The binding means 5 supports the disk 1 by means of a collar 7 provided in a middle portion of a supporting shaft 6 passing through the hole 3 of said disk 1, an upper end of said supporting shaft 6 being put in a recess 9 of a projecting shaft 8 projecting from a central upper portion of said cap plate 4, and a ball 10, which has been projected toward an inner circumference of said recess 9 by a spring pressure, being detachably engaged with a projecting member 11 projecting from an outer circumference of said supporting shaft 6.

In addition, a disk 13 having a small diameter is disposed on a ring projection 12 formed on said disk 1 so as to be supported thereby below the cap plate 4, said supporting shaft 6 passing through also a central hole of said disk 13.

A plurality of pins 14 fixedly mounted on the disk 13, are passed through a plurality of pin holes formed in the cap plate 4 disposed thereabove, an upper limit of the cap plate 4 being set by means of heads 15 formed at upper ends of the pins 14, and the cap plate 4 being supported at appointed positions by means of springs 16 on the pins 14.

Reference numeral 17 designates a receiving seat of the disk 1. The receiving seat 17 is elevatably supported by means of a plurality of guide pins 19 provided with stoppers 18 at upper ends thereof and lifted up by means of a springs 20 until it is brought into contact with the stoppers 18. In addition, cylindrical cutting edge 33 of a cutting device 32 is arranged around an outer circumference of the receiving seat 17 with some gap therebetween as shown in FIG. 1, 3, 4 and 5.

A large number of guides 22 for guiding long grinding belts 21 are provided on the respective radial lines outside of the whole circumference of said receiving seat 17. The respective guides 22 have a groove shape the upper portion of which is opened, so that the respective grinding belts 21 may be overlapped, with an incline being provided to the grooves 22 to facilitate sliding of the belts 21 in the direction of the center of the disk 1 with the desired overlap of the belts 21.

Figure 1:
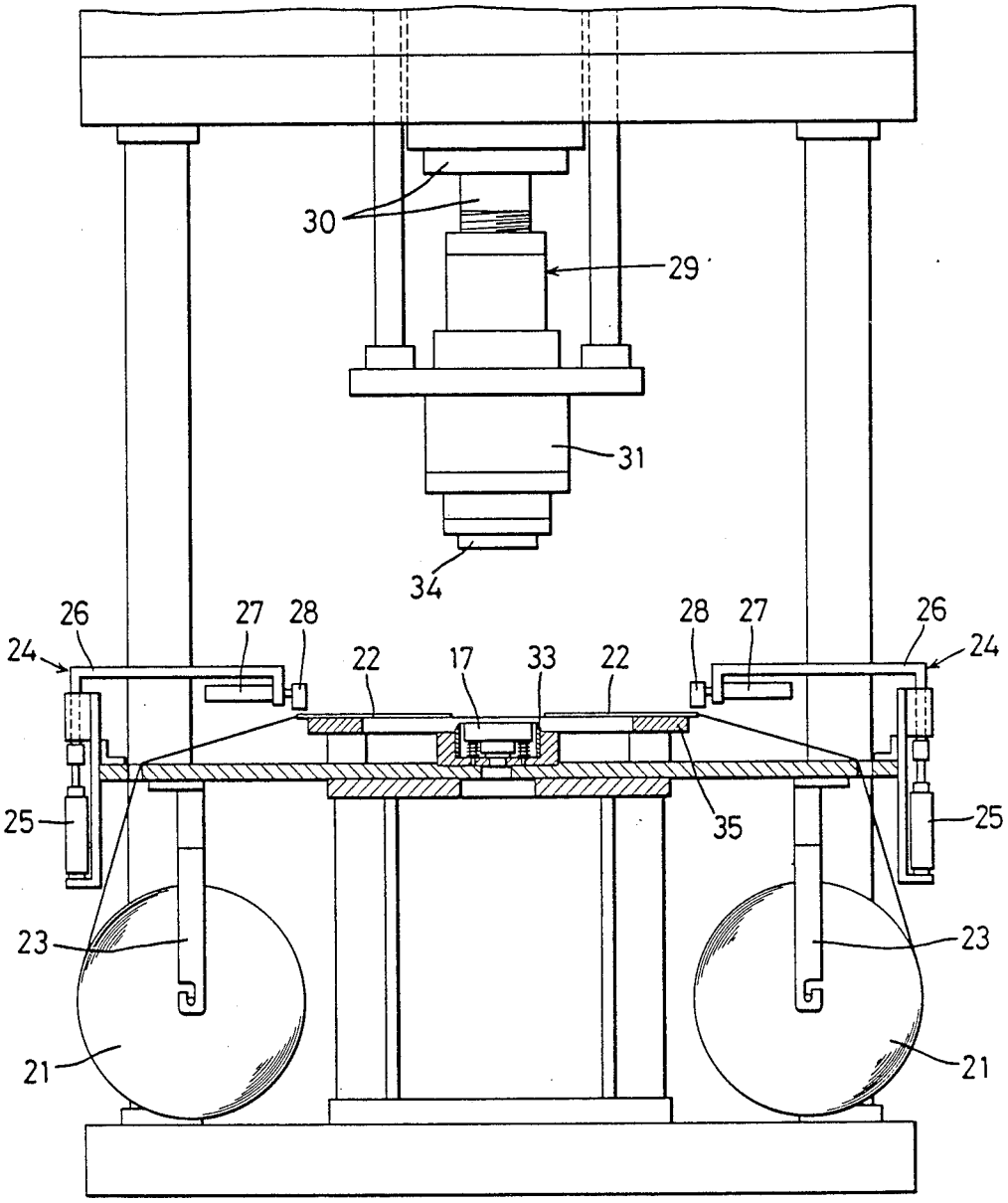
FIG. 1 is a partially cut off longitudinally sectioned front view showing a first preferred embodiment of a grinding tool according to the present invention.
Figure 2:
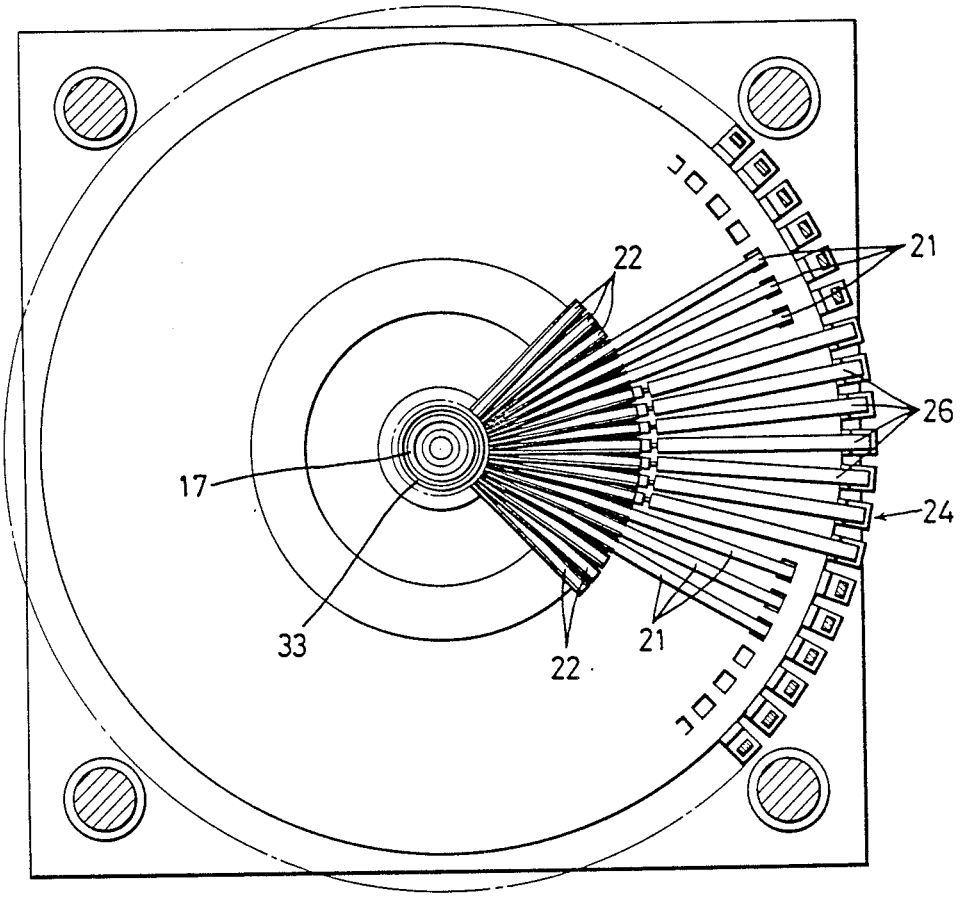
FIG. 2 is a cross-sectioned plan view of FIG. 1.

In addition, the above described grinding belts 21 are rolled up to be supported by means of a trestle 23, as shown in FIG. 1.

Reference numeral 24 in FIG. 1 designates a feed means for feeding the grinding belts 21.

The feed means 24 comprises a reverse L letter-shaped arm 26 elevating by means of a first cylinder 25, a second cylinder 27 supported on a pointed end of said arm 26 and a click feed member 28 provided on a pointed end of a piston rod of said second cylinder.

Reference numeral 29 in FIG. 1 designates a pressurizing apparatus for the pressing plate 4.

The pressurizing apparatus 29 comprises a circular edge receiver 34, which is brought into contact with an upper surface of said cylindrical cutting edge 33, is fixedly mounted on a lower end of an elevator 31 elevating by means of a third cylinder 30 in a concentric manner.

The first preferred embodiment of an apparatus according to the present invention has the above described construction. At first, as shown in FIGS. 4, 5, the disk 1, to which the adhesives 2 have been applied, is bound to the cap plate 4 by means of the binding means 5 to be placed on the receiving seat 17.

Figure 3:
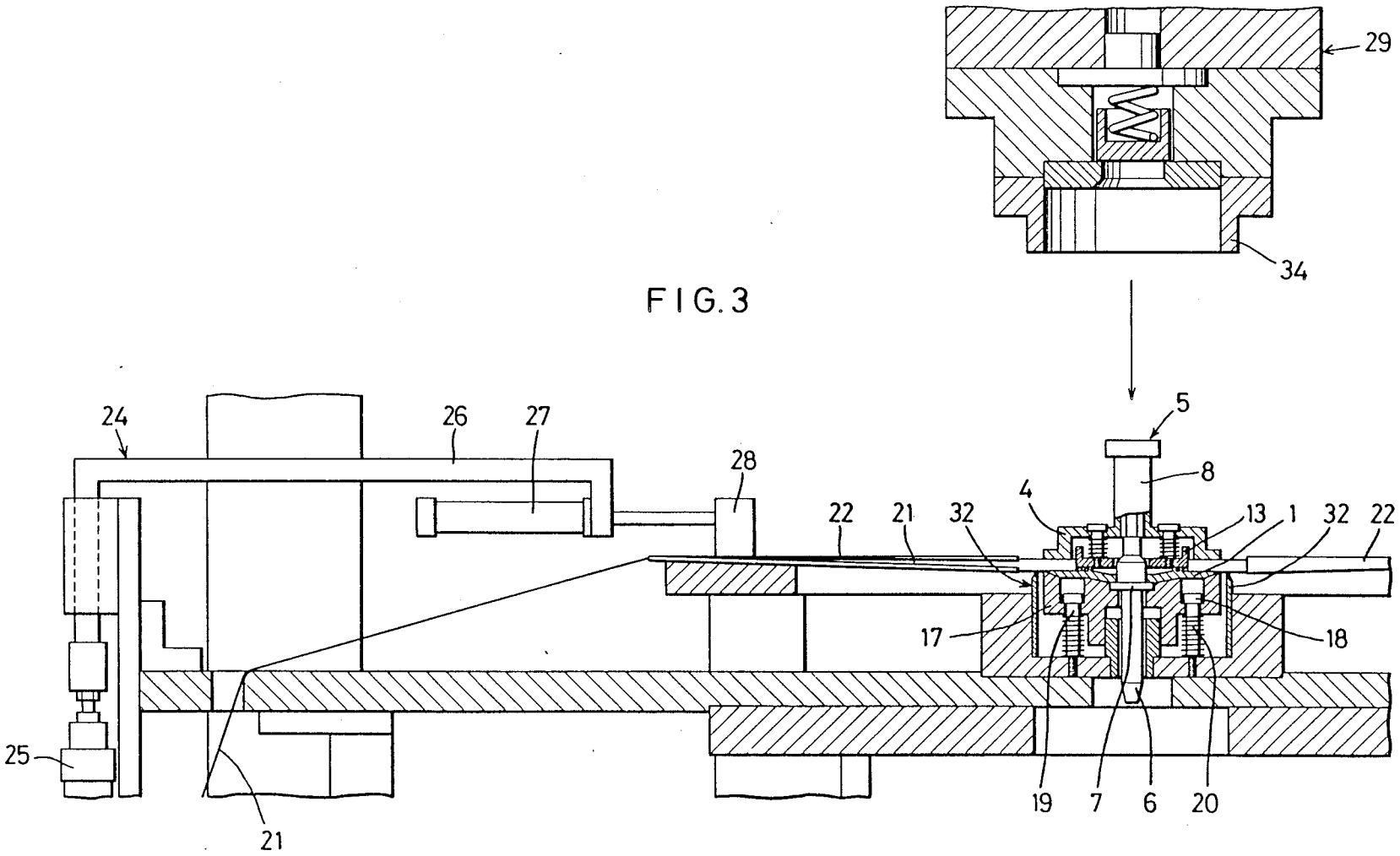
FIG. 3 is an enlarged longitudinally sectioned front view showing principal parts of the first preferred embodiment of a grinding tool according to the present invention.

Then, the arm 26 is descended by means of the first cylinder 25 of the feed means 24 shown in FIG. 1 to press the feed member 28 against the grinding belt 21 on a support plate 35 and then stopped in this condition. At this point of time, the disk 1 applied with the adhesives is put into the center and sad feed member 28 is made to advance in the direction of the center as shown in FIG. 3 by the extending operation of the second cylinder 27, to feed the grinding belt 21 and insert its pointed end into a gap between the disk 1 and the cap plate 4, as shown in FIG. 4.

After the completion of feeding, the elevator 31 is descended by means of the cylinder 30 of the pressurizing apparatus 29 and an edge receiver 34 provided at a lower end of the elevator 31 is pressed against the respective grinding belts 21 on the cylindrical cutting edge 33 of cutting device 32, as shown in FIG. 5, to cut the respective grinding belts 21. Subsequently, the feed member 28 is raised by means of the first cylinder 25 to retreat the feed member 28.

In addition, the respective grinding belts 21, which are cut by the compression of the springs 16 by means of the cap plate 4 when the elevator 31 descends in the above described manner, are adhered to the disk 1 the adhesives 2. Then, the arm is descended by means of the first cylinder 25 to press the feed member 28 a the grinding belt on the support plate 35. Next, by the elevator 31 is raised by means of the cylinder 30 to with draw the pressurization on the belts 21 through the cap plate 4.

Figure 8:
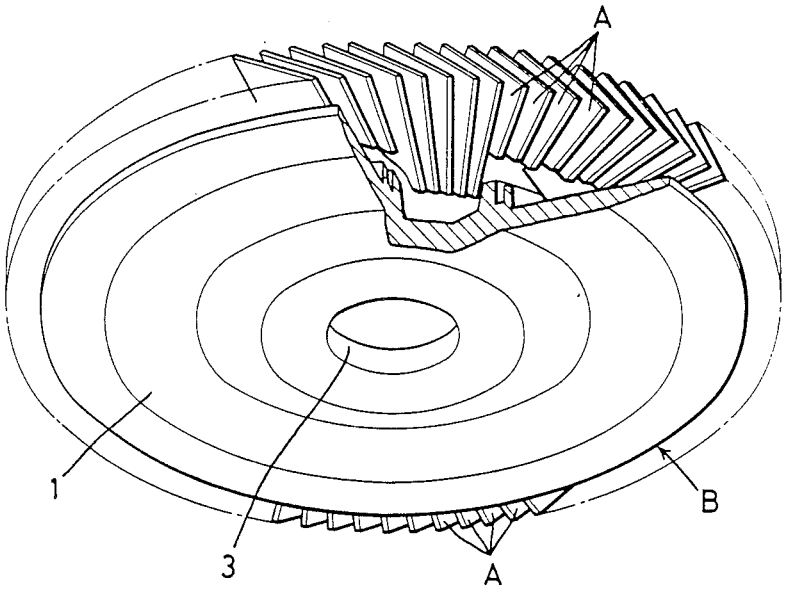
FIG. 8 is a perspective view showing a produced grinding tool.
Figure 9:
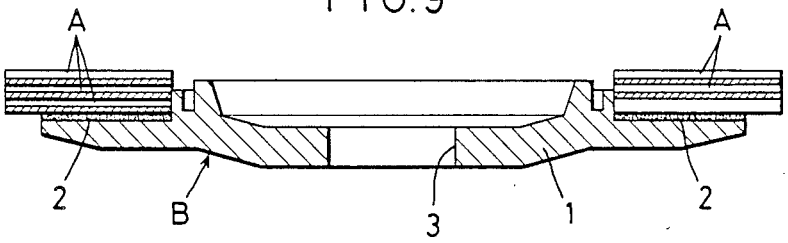
FIG. 9 is a longitudinally sectioned front view showing a produced grinding tool.
Figure 10:
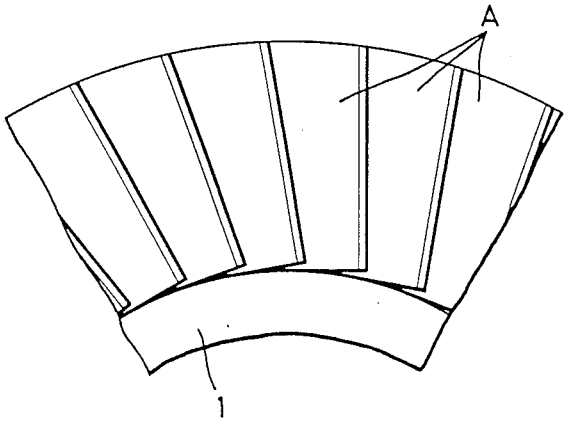
FIG. 10 is a partially cut off bottom view showing a produced grinding tool.

Subsequently, the cap plate 4 and the disk 1, which have been bound by means of the binding means 5, are detached from the receiving seat 17, to be put in a furnace together with the respective grinding belts 21 adhered to the disk 1 and heat left at ambient at normal temperature, whereby solidification of the adhesives occurs. After the solidification of the adhesives, the binding by means of the binding means 5 is withdrawn to recover the cap plate 4, whereby obtaining the grinding tool B as shown in FIG. 8.

Figure 7:
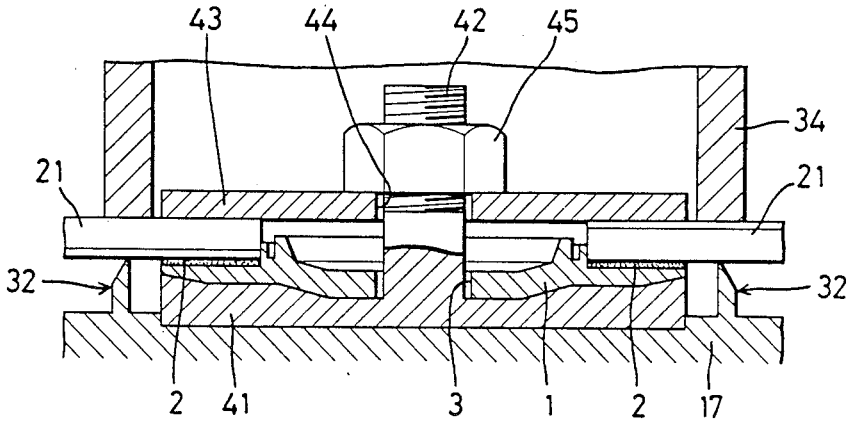
Figure 6:
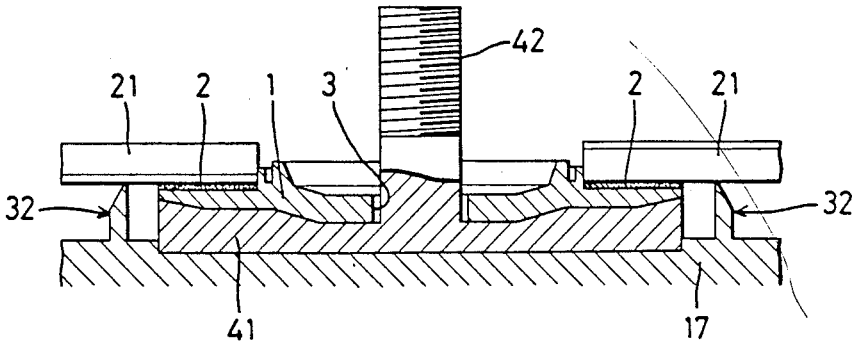
FIG. 6 is a longitudinally sectioned front view showing the condition where a cap plate is manually fitted.

Although an automatic pressurizing method has been described above, another method, illustrated in FIGS. 6 and 7, in which a screw shaft 42 projecting upward from the center of an upper surface of a seat plate 41 is passed through the-through hole 3 to overlap the disk 1 on said seat plate 41, may be used. In this method, the seat plate 41 is placed on said receiving seat 17 followed by feeding of the respective grinding belts 21 by means of said feed means 24. Subsequently, a central hole 44 of a cap plate 43 is put on the screw shaft 42 and a nut 45 is screwed on said screw shaft 42 to press the respective grinding belts 21 against the disk 1 by means of the above described cap plate 43, as shown in FIG. 7. Then, the respective grinding belts 21 are cut by means of a cutting device 32 on the receiving seat 17 in the same manner as in FIG. 5. Alternatively, a cylindrical edge provided on a side of the elevator 31 may be used as a cutting device in addition to the above described preferred embodiment. Furthermore, the cutting operation may be carried out by rotating an edged tool in place of using a cylindrical edge.

With the method of producing the grinding tool and the apparatus for producing the grinding tool according to the first preferred embodiment, as above described, a large number, of long grinding belts radially arranged are fed radially inward toward the center to be overlapped on the disk over the adhesives and then pressurized to adhere the grinding belts to the disk, followed by cutting of the respective grinding belts at the appointed positions on the outer side of the circumferential edge of the disk, so that the production efficiency is remarkably improved in comparison with that in the conventional method of producing a grinding tool mainly using manual operations.

Figure 20:
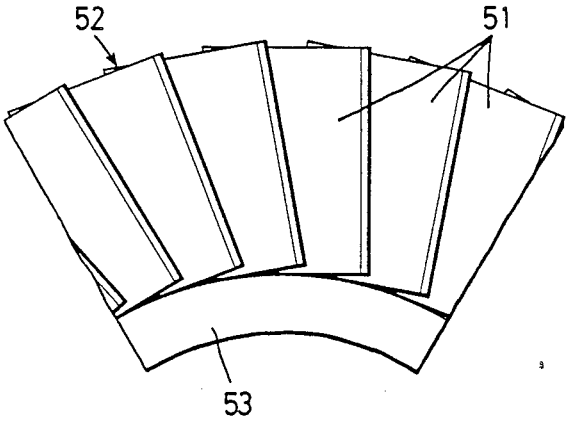
FIG. 20 is an enlarged bottom view showing the conventional grinding tool.

Furthermore, uniform products can be obtained. In addition, in a method in which the rectangular grinding sheets are stuck to each other, such as the conventional method of producing a grinding tool, there is the possibility that an outer circumference of the tool will be uneven as shown in FIG. 20, so that he work being ground may be damaged by the projections at the corners of the sheets. On the contrary, as to the grinding tool obtained by the method of producing a grinding tool according to the present invention, the circumference of the grinding sheet is circularly cut by means of the cylindrical cutting edge or rotation of an edged tool, so that the problem can be avoided.

A second preferred embodiment uses a heating device and the same parts as in the first preferred embodiment are marked with the same reference numerals as in the first preferred embodiment.

Figure 14:
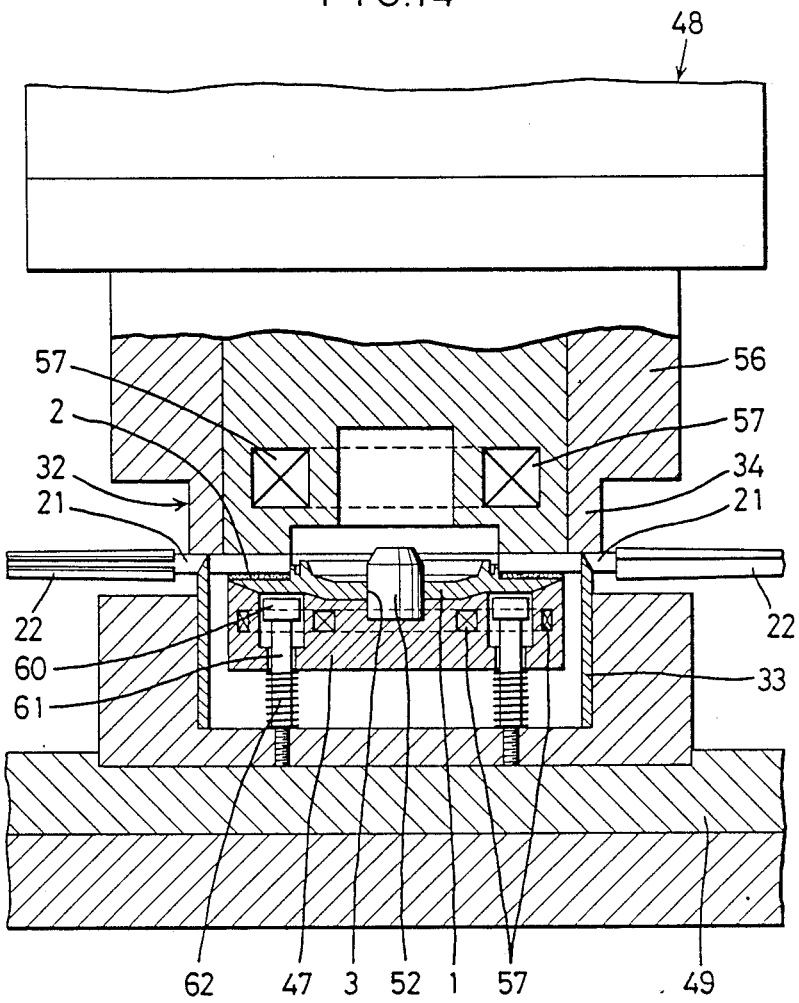
FIG. 14 is a longitudinally sectioned front view showing the condition when pressurized.

Referring to FIG. 14, reference numeral 47 designates a heating receiving seat. An elevatable heating and pressurizing device 48 is provided above said receiving seat 47.

The heating and pressurizing device 48 and heating receiving seat 47 are disposed on a table 49.

In addition, the heating and pressurizing device 48 comprises a cylinder 55 disposed on a frame 54 and a circular pressurizing member 56 mounted on a pointed end of a piston rod of said cylinder 55.

The heating receiving seat 47 and heating and pressurizing device 48 are adapted to be heated to a predetermined temperature by means of heating elements 57 respectively incorporated inside thereof.

A large number of guides 22 are radially and fixedly mounted on the whole outer circumference of the heating receiving seat 47.

Figure 12:
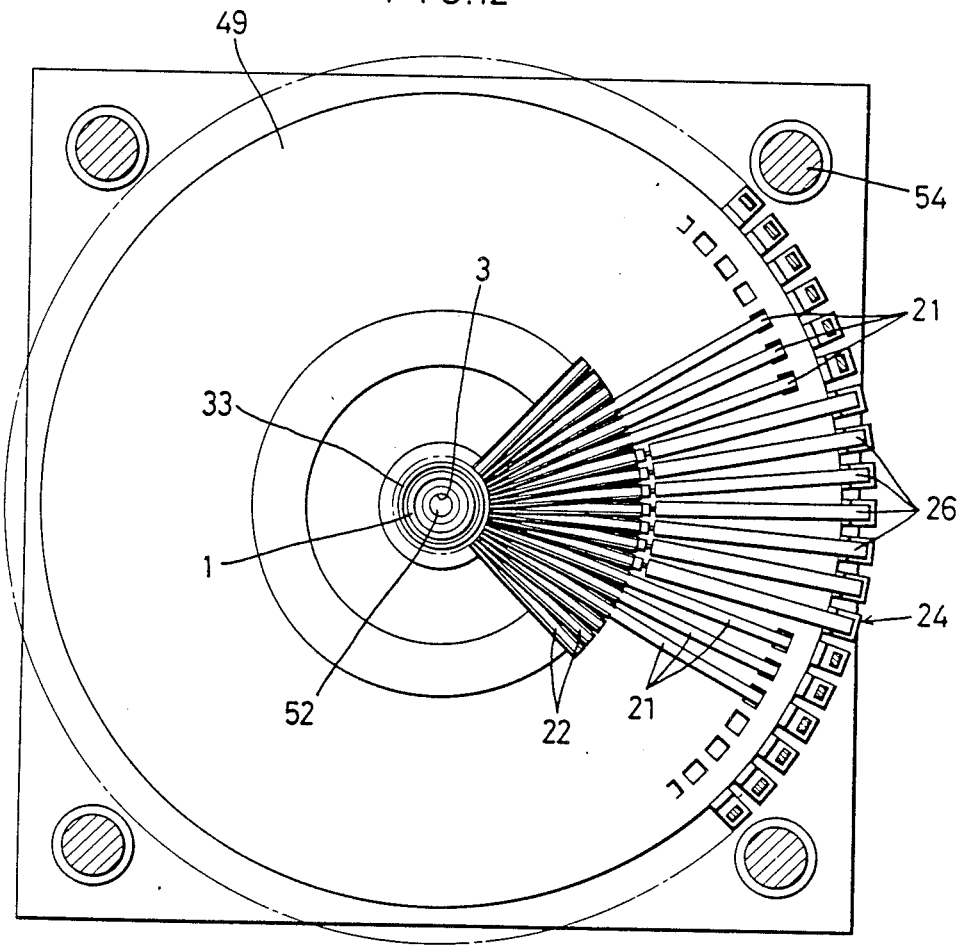
FIG. 12 is a cross sectioned plan view of FIG. 11.

These guides 22 are formed of inclined groove-shaped members the upper portions of which are open, as shown in FIG. 12. The respective grinding belts 21 are overlapped with the aid of the incline of guides 22 when guided therein radially inward toward the center of the disk in the same manner as in the first preferred embodiment.

The heating receiving seat 47 is elevatably supported by means of a plurality of guide pins 61 provided with a stopper 60 at an upper end thereof, as shown in FIG. 14, and lifted up until it is brought into contact with the stopper 60 by means of springs 62. In addition, a cylindrical cutting edge 33 is disposed on an outer circumference of the receiving seat 47 with some gap between them. A circular edge receiver 34 is fixed below said pressurizing member 56 to form a cutting device 32 together with said cylindrical edge 33,.

Figure 11:
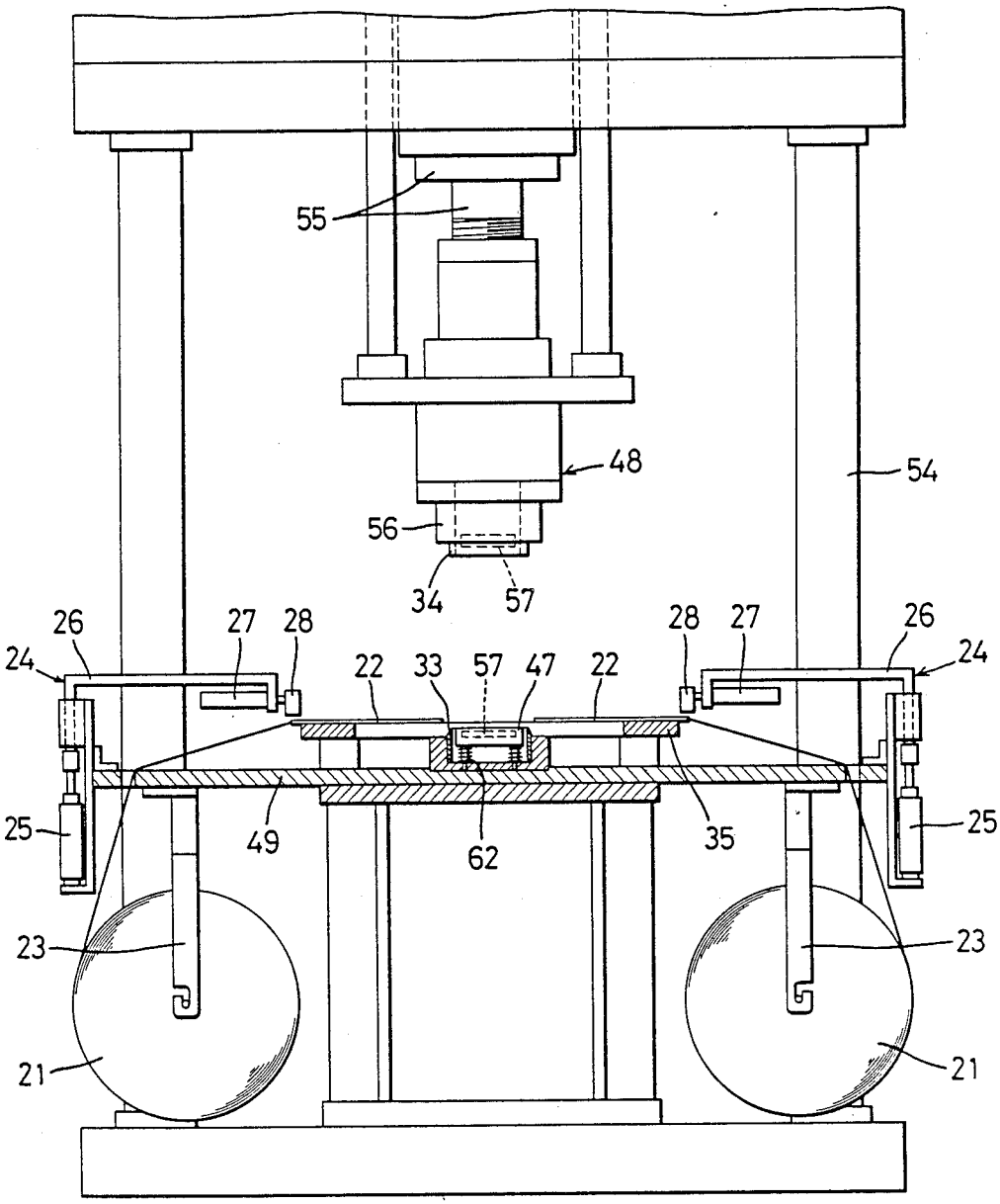
FIG. 11 is a partially cut off longitudinally sectioned front view showing a second preferred embodiment of an apparatus for producing a grinding tool according to the present invention.
Figure 13:
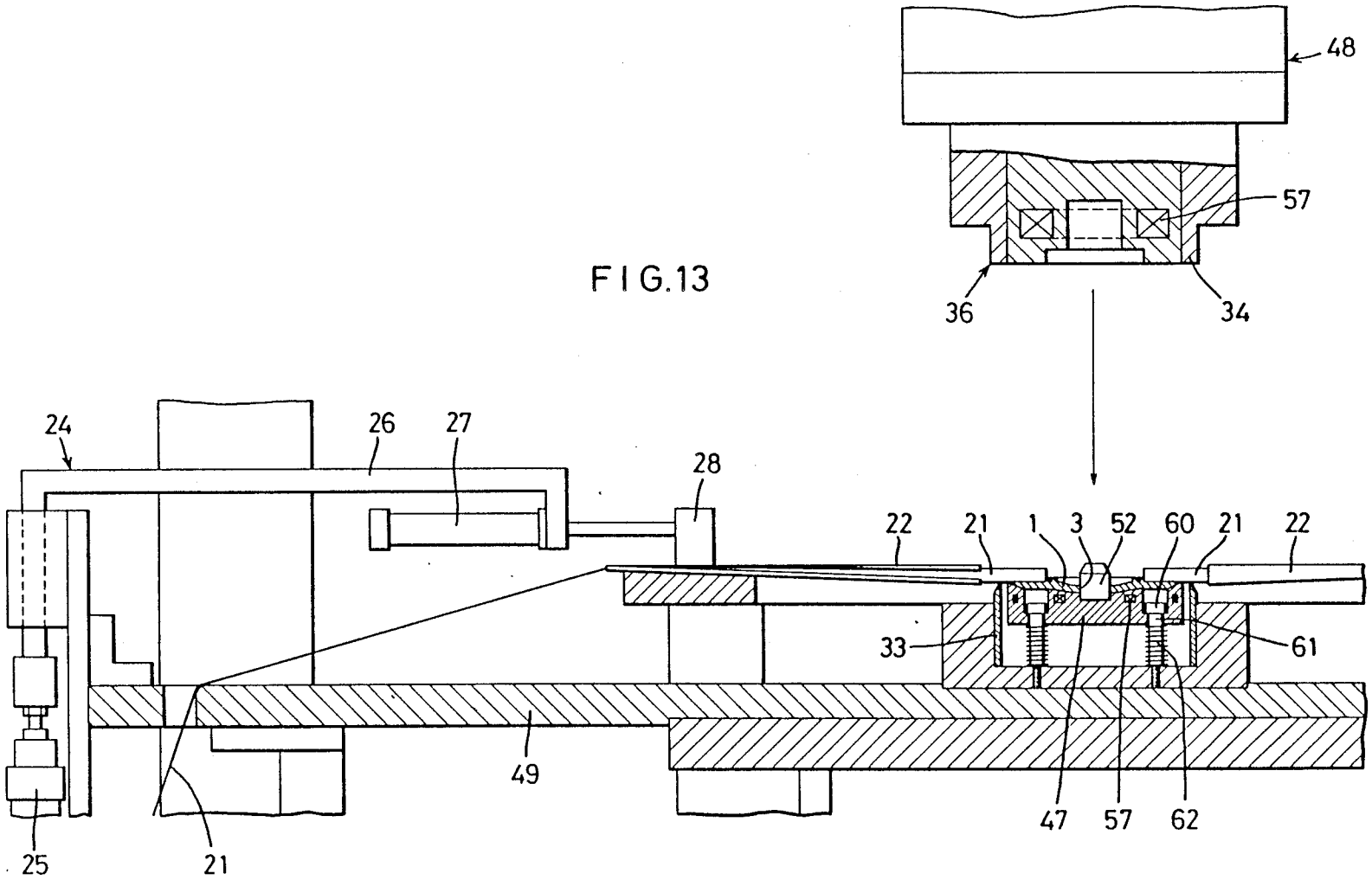
FIG. 13 is an enlarged longitudinally sectioned front view showing principal parts of the second preferred embodiment of a grinding tool according to the present invention.

Furthermore, a method and apparatus for feeding the above described grinding belts 21 are the same as in the first preferred embodiment That is to say, as shown in FIGS. 11 and 13, the grinding bolts 21 are rolled up and supported by means of trestles 23.

A feed means 24 for each of the above described grinding belts 21 comprises a reverse L -shaped arm 26 elevated by means of a first cylinder 25, a second cylinder 27 supported on a pointed end of said arm 26 and a feed member 28 mounted on a pointed end of a piston rod of said second cylinder 27.

The second preferred embodiment of the present invention has the above described construction. At first, as shown in FIGS. 13 and 14, the disk 1, to which heat sensitive adhesives 2 have been applied, is placed on the receiving seat 47 and the central hole 3 is put on the pin 53 disposed at the center of the receiving seat 47 to position the disk 1.

The above described heat sensitive adhesives 2 may be previously applied to the disk 1 or ring-shaped heat sensitive adhesives 2 may be previously overlapped on the disk 1, or the heat sensitive adhesives 2 and the disk 1 may be fed in a separated manner.

Then, said feed member 28 is made to advance in the direction of the center of the disk by the extending operation of the second cylinder 27, to feed the grinding belt 21 until a pointed end of the grinding belt 21 arrives at an appointed position before the central hole 3 of the disk 1.

After the completion of the feeding operation, the pressurizing member 56 is descended by means of the cylinder 55 of the heating and pressurizing device 48 to press the disk 1 and the respective grinding belts 21 against the heating receiving seat 47 and the heat sensitive adhesives 2 made molten by means of the heater 57 to adhere the respective grinding belts 21 to the disk 1. At that time, the respective grinding belts 21 are cut by means of the edge receiver 34 and the cylindrical cutting edge 33 disposed at an end of the cutting device 32 to obtain a grinding sheet A.

Figure 15:
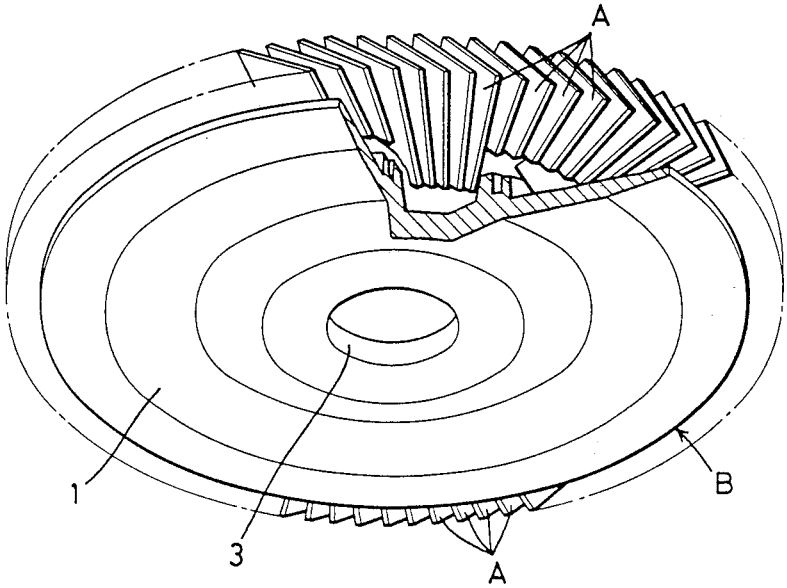
FIG. 15 is a partially cut off perspective view showing a produced grinding tool.
Figure 16:
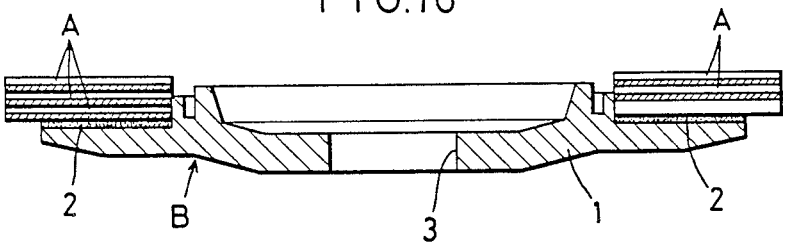
FIG. 16 is a longitudinally sectioned front view showing a produced grinding tool.
Figure 17:
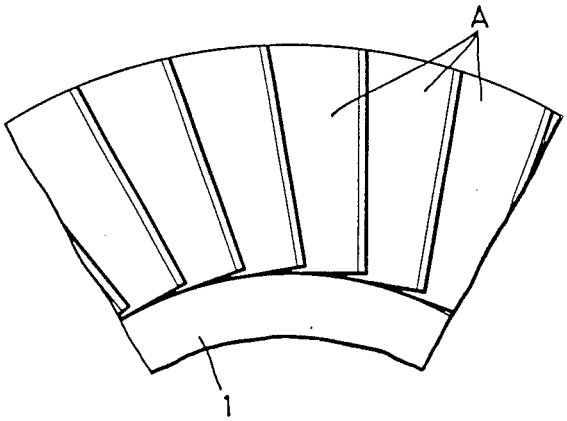
FIG. 17 is a partially cut off enlarged bottom view showing a produced grinding tool.

Subsequently, the arm 26 is descended by means of the first cylinder 25 of the feed means 24 shown in FIG. 11 to press the feed member against the grinding belt 21 on the support plate 35 and the feed member 28 is ascended by means of the first cylinder 25 to withdraw the feed member 28. The pressurizing member 56 is raised by means of the cylinder 55 to expose a grinding tool B as shown in FIG. 15 on the surface of the heating receiving seat 47.

Figure 18:
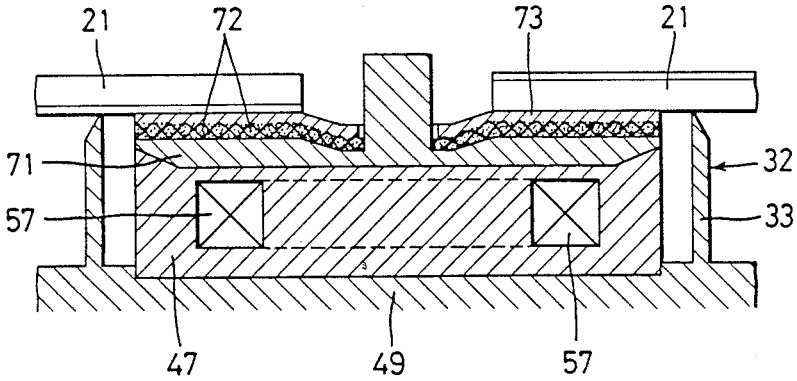
FIG. 18 is a longitudinally sectioned front view showing another preferred embodiment.
Figure 19:
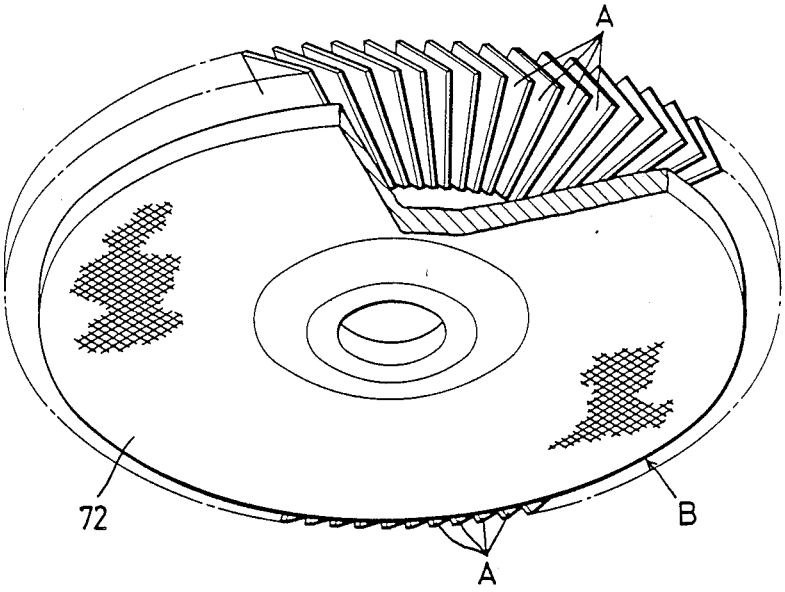
FIG. 19 is a perspective view showing a grinding tool produced by the apparatus shown in FIG. 18.

FIGS. 18, 19 show the manual method. In this case, a mother die 71 is placed on the heating receiving seat 47.

This mother die 71 is formed of heat conductive materials. A disk material 72 formed of a net made of glass fibers or the like is placed on said mother die 71, and an adhesive material 73 such as scattered powdery heat sensitive, or overlapping plate-like heat sensitive adhesives, are provided on said disk material 72.

A large number of grinding belts 21 are fed to be heated and pressurized, whereby melting of the heat sensitive adhesives causes the grinding belts 21 to adhere to the disk 1. The belts are then cut by means of the cutting device to obtain a grinding tool B as shown in FIG. 19 in the same manner as in other preferred embodiments.

Although similar results in the first preferred embodiment can be achieved also in the above described second preferred embodiment, in this second preferred embodiment the disk is placed on the heating receiving seat and the respective grinding belts are adhered to the disk by the use of the heat sensitive adhesives, so it is not required to leave the materials unattended for a long time after the adhesion, whereby productivity is remarkably improved.

What is claimed is:

1. A method of producing a grinding tool, comprising the steps of:

providing on a receiving seat, a disk having a through hole at a center thereof and an adhesive layer on an upper surface of a circumferential edge portion thereof, feeding forward end portions of a plurality of grinding belts distributed about the periphery of the receiving seat radially inward toward the center of the disk to predetermined positions of the disk covering the adhesive layer, such that adjacent side edges thereof overlap each other, each of the overlapping end portions of the grinding belts having a grinding particle surface on a same side thereof facing away from the adhesive layer;

pressing a pressing plate against the respective end portions of the grinding belts on the adhesive layer to adhere to the respective end portions of the grinding belts to the disk and holding the pressing plate against the end portions of the grinding belts while solidifying the adhesive layer;

cutting the grinding belts on a circular line in a vicinity of an outer circumference of the disk to separate the end portions of the grinding belts from remaining portions of the grinding belts;

separating the pressing plate from the end portions of the grinding belts and the disk after solidification of the adhesive layer; and after said step of separating, removing the disk from the receiving seat.

2. An apparatus for producing a grinding tool, comprising:

a receiving seat for receiving a disk provided with an adhesive layer on an upper surface of a circumferential edge portion thereof;

feeding means for feeding forward end portions of a plurality of grinding belts toward a center of the disk, with the disk placed on said receiving seat, and onto the adhesive layer with adjacent side edges of the end portions of the grinding belts overlapping each other and with a grinding particle surface of the end portions of the grinding belts facing away from the adhesive layer;

a pressing plate for pressing the overlapping end portions of the grinding belts on the adhesive layer on the disk against the disk; and a detachable binding means for holding the pressing plate pressed against the overlapping end portions of the grinding belts on the adhesive layer on the disk to bind the overlapping end portions of the grinding belts to the disk.

3. An apparatus as in claim 2, further comprising means for cutting the overlapping end portions of the grinding belts on the adhesive layer on the disk away from remaining portions of the grinding belts along a circular line in a vicinity of an outer circumference of the disk.

4. A method of producing a grinding tool, comprising the steps of:

providing on a receiving seat, a disk having a through hole at a center thereof and a heat sensitive adhesive on an upper surface of a circumferential edge portion thereof, feeding forward end portions of a plurality of grinding belts distributed about the periphery of the receiving seat radially inward toward the center of the disk to predetermined positions of the disk covering the adhesive, such that adjacent side edges thereof overlap each other, each of the overlapping end portions of the grinding belts having a grinding particle surface on a same side thereof facing away from the adhesive;

pressing a pressing plate against the respective end portions of the grinding belts on the adhesive layer to adhere the respective end portions of the grinding belts to the disk;

holding the pressing plate against the end portions of the grinding belts;

during said step of holding;

cutting the grinding belts on a circular line in a vicinity of an outer circumference of the disk to separate the end portions of the grinding belts from remaining portions of the grinding belts, heating the pressing plate and the receiving seat to heat and melt the adhesive, and solidifying the melted adhesive to fix the end portions of the grinding belts to the disk;

separating the pressing plate from the end portions of the grinding belts and the disk after solidification of adhesive; and after said step of separating, removing the disk from the receiving seat.

5. The apparatus for producing a grinding tool, comprising:

a receiving seat for receiving a disk provided with a heat sensitive adhesive on an upper surface of a circumferential edge portion thereof;

feeding means for feeding forward end portions of a plurality of grinding belts toward a center of the disk, with the disk placed on said receiving seat, and onto the adhesive with adjacent side edges of the end portions of the grinding belts overlapping each other and with a grinding particle surface of the end portions of the grinding belts facing away from the adhesive; and heating and pressurizing means, including a pressurizing member and heating elements in said pressurizing member and said receiving seat, for pressing against the overlapping end portions of the grinding belts on the adhesive toward the disk and heating the adhesive on the disk with the pressurizing member pressed against the overlapping end portions of the grinding belts, said heating and pressurizing means having means for withdrawing the pressurizing member from the overlapping end portions of the grinding belts.

6. An apparatus as in claim 5, further comprising means for cutting the overlapping end portions of the grinding belts on the adhesive on the disk away from remaining portions of the grinding belts, along a circular line in a vicinity of an outer circumference of the disk.

7. An apparatus as in claim 5, wherein said withdrawing means carries said pressurizing member and comprises means for moving sad pressurizing member against the overlapping end portions of the grinding belts on the adhesive on the disk.

* * * * *